United States Patent [19]

D'Agnolo

[11] 4,168,605

[45] Sep. 25, 1979

[54] SPINDLE FOR DOUBLE TWISTING WITH PNEUMATIC THREADING

[75] Inventor: Armando D'Agnolo, Porcia, Italy

[73] Assignee: Officine Savio, S.p.A., Pordenone, Italy

[21] Appl. No.: 899,229

[22] Filed: Apr. 24, 1978

[30] Foreign Application Priority Data

Dec. 28, 1977 [IT] Italy ..... 83559 A/77
Dec. 30, 1977 [IT] Italy ..... 83562 A/77

[51] Int. Cl.[2] ..... D01H 7/86; D01H 15/00

[52] U.S. Cl. ..... 57/279; 57/58.7; 57/58.83

[58] Field of Search ..... 57/34 R, 34.5, 58.49, 57/58.7, 58.83, 279, 280

[56] References Cited

U.S. PATENT DOCUMENTS

| | | | |
|---|---|---|---|
| 2,715,308 | 8/1955 | Soussloff et al. | 57/58.7 X |
| 3,552,111 | 1/1971 | Treus et al. | 57/58.49 |
| 3,731,478 | 5/1973 | Franzen | 57/58.7 |
| 3,830,051 | 8/1974 | Veltges | 57/58.83 |
| 3,945,184 | 3/1976 | Franzen | 57/58.7 X |
| 3,975,893 | 8/1976 | Franzen | 57/34 R |

*Primary Examiner*—John Petrakes
*Attorney, Agent, or Firm*—Stevens, Davis, Miller & Mosher

[57] ABSTRACT

A spindle for double twisting with pneumatic threading, comprising a tubular stationary part coaxially positioned above a rotatable part containing a yarn passage conduit therein, the stationary part and rotatable part together forming a nozzle creating a venturi effect along the axial portion of the yarn passage conduit, a pressurized fluid feed conduit in the rotatable part, the stationary part defining a reception and distribution chamber in communication with the pressurized fluid feed conduit, a pressurized fluid transport conduit, a yarn clamp within the tubular stationary part and a pneumatically operated piston for overcoming the braking pressure of the clamp.

7 Claims, 7 Drawing Figures fig. 1
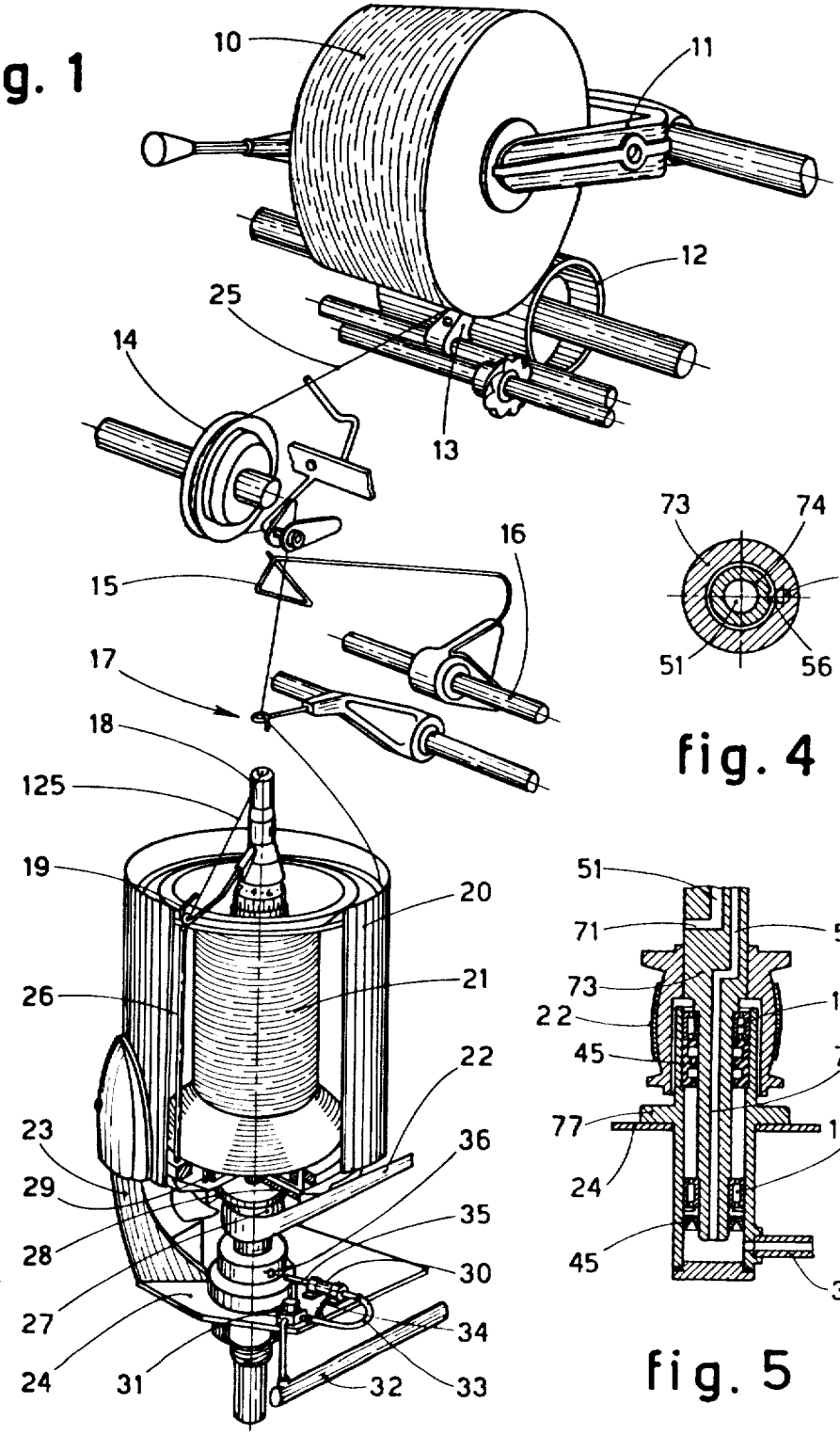
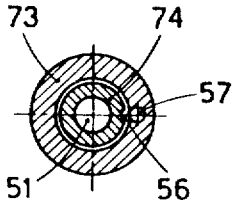
fig. 4
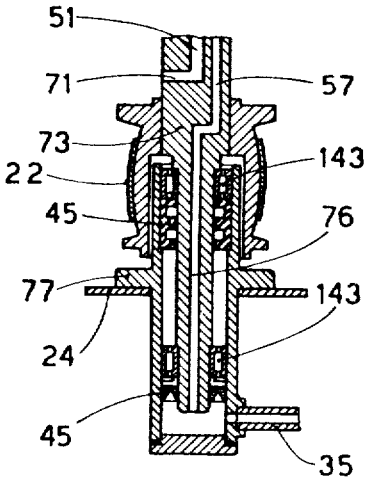
fig. 5

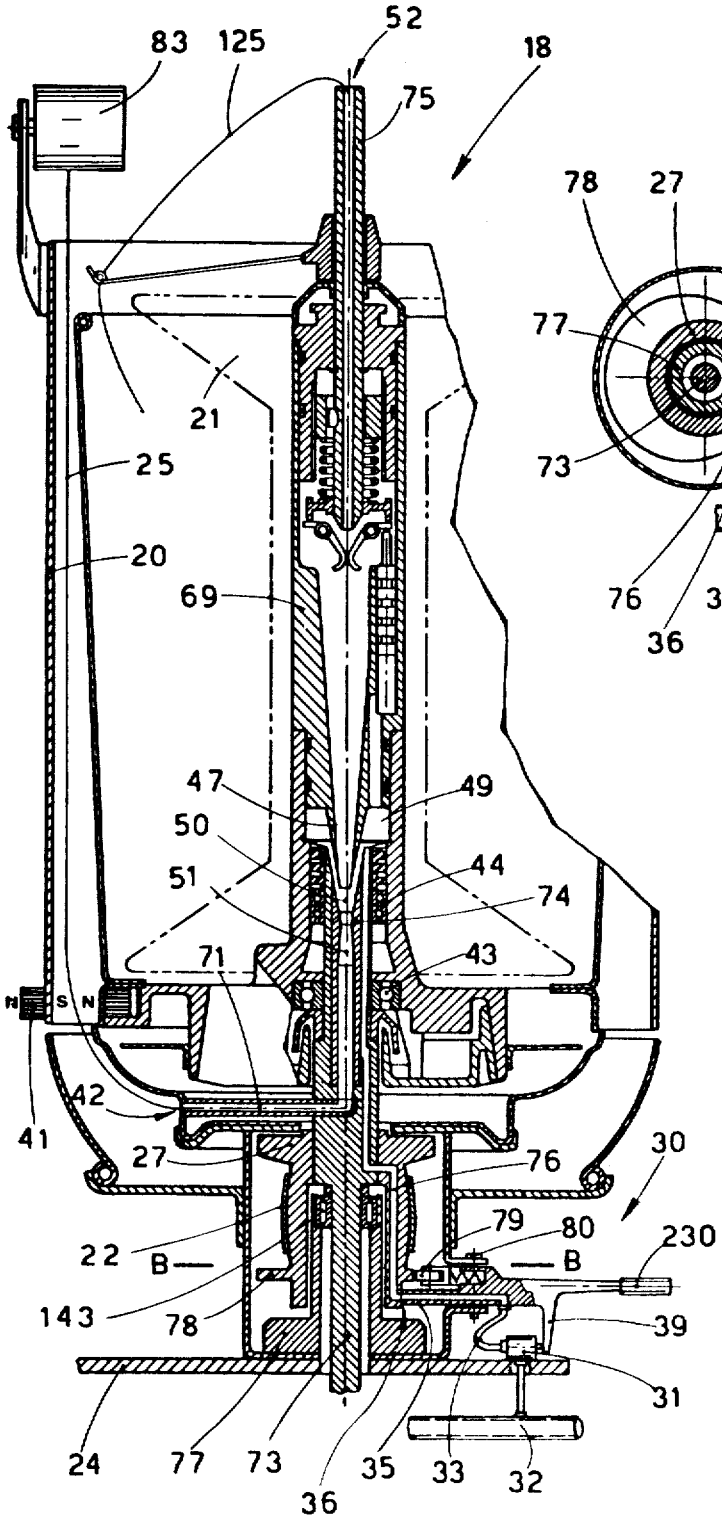
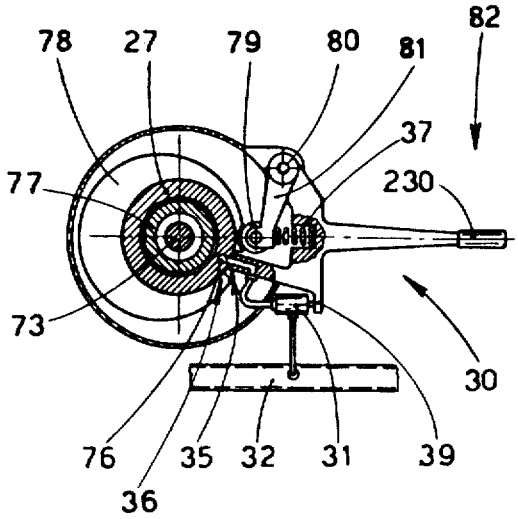
fig. 7
fig. 6

SPINDLE FOR DOUBLE TWISTING WITH PNEUMATIC THREADING

The invention relates to a spindle for double twisting of yarn with pneumatic threading. More precisely, the present invention relates to double twisting machines whereby the threading of the yarn is achieved with the aid of a pressurized jet of air.

There are many known types of spindles in double twisting machines. One type of spindle makes use of a stationary bobbin central thereto whereby the yarn from the spindle rises upwardly, enters into a bore central to the spindle and descends therein to emerge radially and rises upwardly forming a second twist balloon before being taken up again by a bobbin.

A second type is substantially similar to the first except that it makes use of loops which allow the doubling of the yarn directly in the twisting phase.

A third type provides for the inverse path of the yarn whereby the take up bobbin of the yarn, which has experienced double twisting, is positioned on top of a rotating disk.

It is known that the spindles are normally positioned along the two longitudinal fronts of the machine and that the first and second type are normally driven by belts.

It also is known that the introduction of the yarn in the hollow bore of the spindle has always been a problem since this operation is difficult and costly.

Many devices have been studied in order to simplify such an operation. U.S. Pat. No. 2,715,308 provides a spindle of the third type in which the introduction of the yarn is facilitated by the use of an air jet operating in an injector positioned coaxially to the delivery tube and coaxial with the spindle.

The injector creates a negative pressure in the bore which in turn draws the yarn into the bore.

French Pat. No. 1,045,449 provides an air jet coaxial to the spindle and positioned on top of it. This device consists essentially of a compressed air spoiler used in other fields but it requires a complicated and difficult application due to the need of providing steering control thereto.

Swiss Pat. No. 289,957 provides a fixed injector cooperating with a rotating yarn distributor, the fixed injector being directed against the rotating part.

British Pat. No. 501,504 shows in FIG. 6 that for introducing the yarn in a rotating distributor, an injector is made use of which is directed towards the rotating part, the injector being made partly in the fixed portion and partly in the mobile portion.

U.S. Pat. No. 3,706,407 presents in FIG. 2 a similar solution to that of British Pat. No. 501,504 mentioned above.

In the specific field of double twist spindles there also is U.S. Pat. No. 3,975,893 which provides a jet of air through the yarn guide channel, where the air jet is operating in an injector positioned in the fixed part of the spindle and coaxial to the spindle, and the whole is positioned on top of the rotating part of the spindle.

The device of U.S. Pat. No. 3,975,893 is a specific techical embodiment of an idea, as said before, already known in its general and particular formulation as regards the application on the yarn of an injector to rotating distributor means.

Such a specific technical solution, to a large extent, is obvious in the light of the indicated prior art. Appreciable instead is the compressed air transport system to the ring of the injector which permits the functioning of the injector itself.

transport system to the ring of the injector which permits the functioning of the injector itself.

The solution adopted for the transport of compressed air, is made necessary in this formulation by the fact that the feed chamber of the injector is completely formed in the fixed part of the spindle. By this arrangement the compressed air feed conduit to the injector must necessarily be placed in the fixed part of the spindle.

This solution, presents many operational disadvantages, some of which are the impossibility of defining with exactness the position of the yarn exit from the double twist bell, and thus the impossibility of drawing and positioning the yarn head automatically, and the risk of error and damage where it proceeds to thread the yarn in the rotating spindle.

In addition, the known types of double twist spindle with pneumatic threading, as stated above, present many technical inconveniences, which may be concerned with the operational or constructional aspects, and may prevent continuous regulation and setting up.

Lastly, the known types of spindle impede high precision. Thus they are incompatible with modern high rate and economic line production as well as with maintenance and regulation as is necessary in a textile establishment as required by correct machine use which is customary in such an industry.

The present invention eliminates the foregoing disadvantages, is of a simple type of easy construction and assembly without regulation problems and with limited maintenance requirements which in any case do not exceed those required by traditional spindles.

Moreover the invention allows both the positioning, to a fixed spindle of the emerging yarn and the obtaining, in one variant, the possible threading of yarn to a rotating spindle.

The present invention is an improvement to double twist spindles with pneumatic threading insofar as it provides the possibility both to place the yarn in a defined position and to thread the yarn in a rotatable spindle.

According to the present invention, the fluid is sent through a conduit present in the body of the spindle's rotating part as far as the pressurized fluid reception and distribution chamber.

This conduit is placed in connection with the feed source by means of any suitable and controllable system. The conduit may initiate in any suitable position in the externally accessible rotating part (pulley in this case). This necessitates the stopping and positioning of the rotatable part but a precise and well defined position for the yarn exit is obtained.

According to one variant, the conduit can be fed in an axial direction with respect to the rotatable part of the spindle, in which case threading can take place in both stationary or rotating spindles.

Thus the invention can be summed up as a double twist spindle with pneumatic threading including a nozzle creating a venturi effect along the axial portion of the spindle's central conduit.

More specifically the invention comprises a spindle with a pressurized fluid feed conduit leading into a reception and distribution chamber, positioned longitudinally of the rotating part and having a pressurized fluid reception opening, a pressurized fluid transport means, feeding means for pressurized fluid and positioning means for the rotating part, and means for neutralizing the braking pressure of clamps potentially present in the body of the fixed part.

The invention will be best described with the help of the attached drawings, of a non-restrictive example of an embodiment of the invention, in which:

FIG. 1 illustrates an axonometric view of part of a double twisting machine;

FIG. 4 shows a section along line AA of FIG. 3;

FIG. 5 shows a variant;

FIG. 6 shows a variant of FIG. 2; and

FIG. 7 shows a section taken from the top along BB of FIG. 6.

Figure 2:
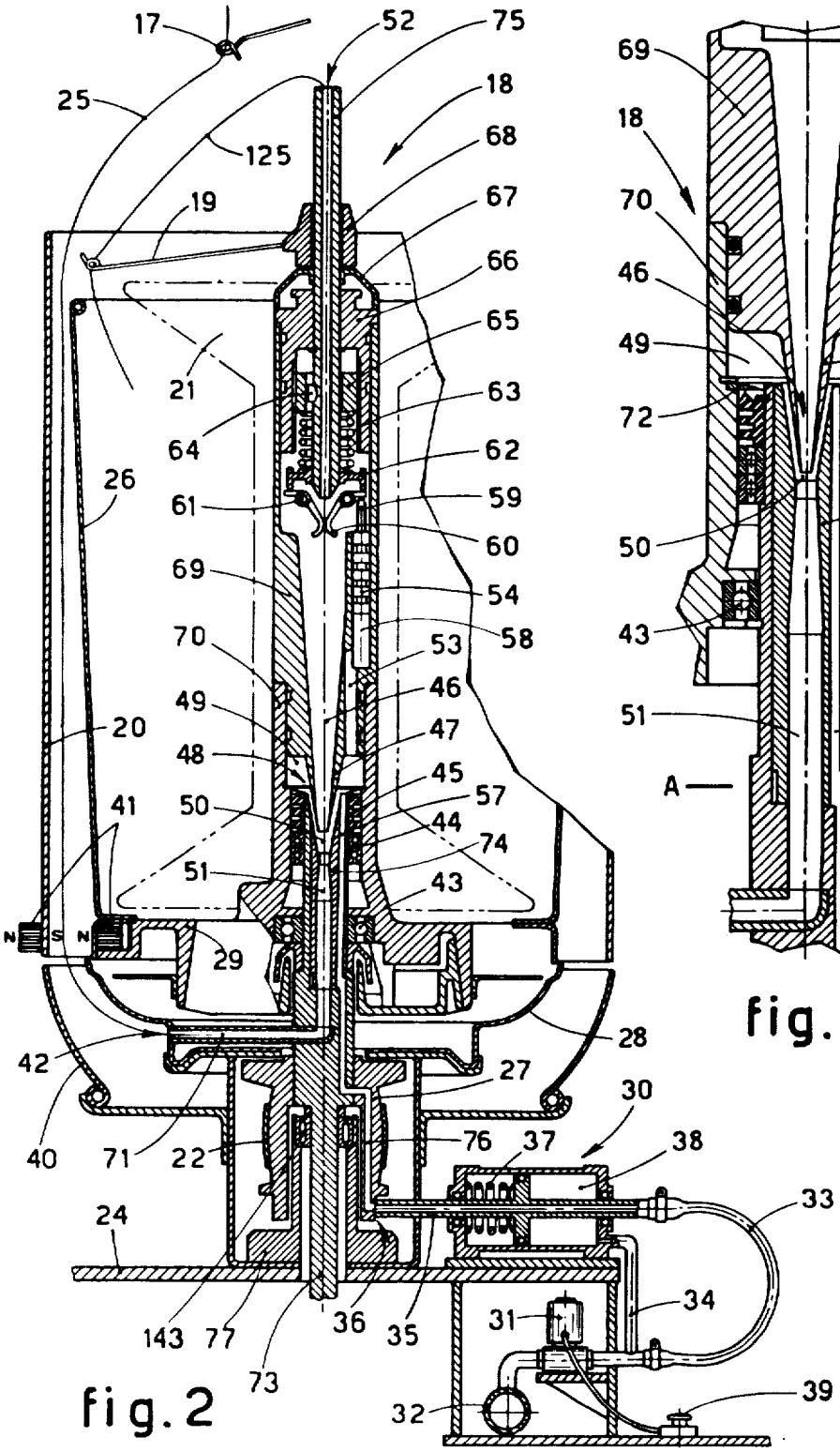
FIG. 2 illustrates a sectioned spindle in accordance with the invention.
Figure 3:
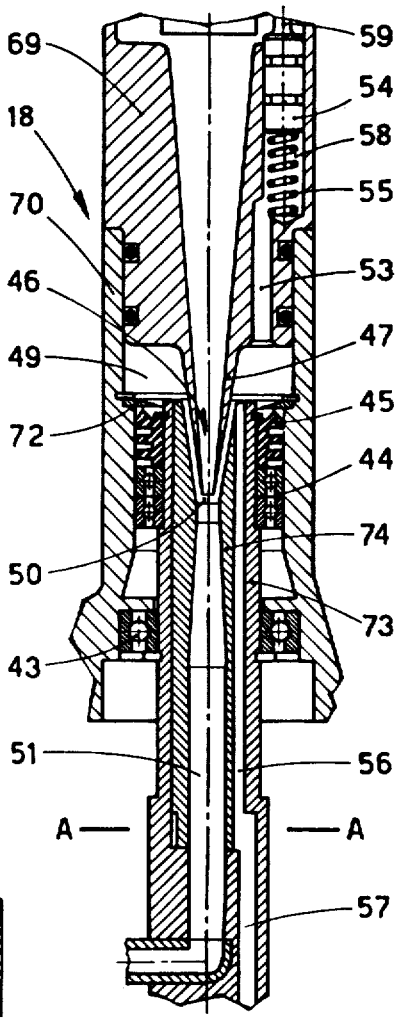
FIG. 3 illustrates an enlarged view of the spindle upper part.

In the drawings similar parts or parts with similar functions carry similar references. In FIG. 1 there is shown a bobbin 10 in a yarn drawing phase, a bobbin carrying arm 11, a feed ring 12, a yarn guide 13, a feed limiting wheel 14 and a bobbin feeler 15 which interrupts bobbin 21 feeding the yarn if the latter is broken. Shaft 16 carries feeler 15. An upper terry 17 is positioned between the feeler 15 and bobbin 21 for limiting the balloon formed by double-twisted yarn 25 as it emerges from balloon breaker container 20. The axially hollow spindle is generically designated as 18. An unwinding terry 19 freely rotates around spindle 18. Yarn 125 is drawn from feed bobbin 21 to be double-twisted. A belt 22 drives pulley 27 which is fixed to the rotating part of spindle 18. Balloon breaker container 20 is carried by support 23 and base 24. Between bobbin 21 and container 20 is an internal cage 26 whose function is to separate the balloon from the unwinding yarn. A fixed part of spindle 18 is plate 29. Means generically designated as 130 supply gaseous fluid necessary for threading the yarn. The means can be of any tpe constituted, e.g., of a third cylinder 30 as in FIGS. 1 and 2 or a special lever 230 as in FIGS. 6 and 7. The means 130 can serve to supply the gaseous fluid only or may also be used as a positioner. An interception means 31 operable when required can be constituted of an electrovalve or switch slide valve or other known means which is fed with pressurized fluid through feed conduit 32. A principal flexible feed conduit 33 for fluid is connected through interceptor 31 to conduit 32. A possible secondary feed conduit 34 is connected to conduit 33. A nozzle 35 connected to conduit 33 cooperates with port 36 and is actuated either by cylinder 30 or by lever 230, to receive pressurized fluid from conduit 33 and conduct it to port 36 through which said fluid is sent to the interior of spindle 18. As an alternative to FIGS. 2 and 6, nozzle 35 in FIG. 5 is fixed to base 77. A spring 37 is positioned in cylinder 30 to return nozzle 35 to a non-operational position after chamber 38 of cylinder 30 has been pressurized by fluid coming through conduit 34 subsequent to interceptor 31 being actuated. Interceptor 31 is actuated by switch 39. The switch may be made a part of the interceptor itself or hand operated, as in FIG. 6, by lever 230. A lower bowl 40 into which the yarn is discharged after emerging from rotating port 42 placed in the bowl 28 is fixed solidly to base 24. The yarn then changes direction upwardly. A pair of magnets 41 of opposed polarities keep part 29 stationary, although part 29 remains easily and rotatably suspended on the rotating shaft 73. Magnets 41 are present on the circumference of container 20 and plate 29 in a plurality of pairs. Port 42 through conduits 71, 51 and 50, is in communication with the axial bore 46, 52 present in spindle 18. Ball bearings 43 and 44 position vertically, the rotatable shaft 73 and the fixed part of spindle 18. Separating baffles 45 function to prevent the pressurized fluid from leaving chamber 49 by reducing its actuation pressure during its reversal. An axial approach port 46 of the nozzle 47 is positioned in the fixed part of the spindle and above the mobile part and may be at least partially positioned within the mobile part. Annular acceleration channel 48 is defined by the exterior of nozzle 47 with the interior of a conical diverging upwardly part of section 50. A reception chamber 49 is defined by the space between the fixed and rotatable parts of spindle 18. The chamber 49 receives the pressurized fluid from conduit 56 present in the rotatable part. The mixing section 50 is defined by the space above the upper end portion of the mobile part, coaxial to the spindle, and just below nozzle 47. A diffuser 51 is positioned in the mobile part of the spindle 18. Interconnecting chamber 49 and chamber 58 is conduit 53 the fluid in which actuates the pneumatic release of clamps 60.

A piston 54 runs in chamber 58 against which spring 55 is elastically pressed. Spring 55 keeps the head 59 of piston 54 and braking clamps 60 in contact so as to render the action of piston 54 more rapid and thereby eliminate dead time. A conduit 56 is bored laterally and longitudinally in rotatable component 74 which defines both channel 48 and the mixing zone 50 as well as diffuser 51 of the injector. There can be advantageously present an annular chamber corresponding to the connection with port 57 for the purpose of rendering the reciprocal positioning of nozzle 35 irrelevant. Longitudinal port 57 is in the vertical element 73 of the rotating part of the spindle. Braking clamps 60 pivotally positioned at 61 are contained in the fixed part of spindle 18. Acting in cooperationg with the outlet of port 52, braking clamps 60 generate pressure which is elastic and adjustable by the ring 62 which transmits to clamps 60 the elastic pressure generated by preloaded spring 63. Key 64 prevents the externally threaded ring 65 from rotating relative to the hollow tube 75 but allowing at the same time the vertical movement of tube 75 to increase or decrease the preload of spring 63. Internally threaded sleeve 66 is screwed to ring 65 and guides the hollow tube 75. The sleeve 66 is fixed to the body 69 of the spindle's fixed part. A graduated ring 67 of rotational application for the positioning of ring 65, is fixed to the hollow tube 75. A support 68 for terry 19 is positioned rotatably around the hollow tube 75. Central body 69 of the fixed part of spindle 18 is fixed to the vertical part 70 of the fixed part 29. Conduit 71 joins diffuser 51 present in the rotating part of the spindle with the outlet part 42. Element 72 acting as a closure and fixture present in the fixed part of spindle 18 cooperates with baffles 45. Central vertical element 73 of the rotatable part of spindle 18 has bearings 43 and 44 mounted thereon and is rotatably sustained by bearing 143. Part 74 of the injector as present in the rotatable part of spindle 18, is shrunk-on in the vertical element 73. Hollow tube 75 is uppermost for the introduction of yarn 125. Axial conduit 76 connects with port 57. The axial port 57 is present in the lower part of vertical sleeve 73 in the variant of FIG. 5, while in FIG. 2 the port is present in the pulley 27. Support 77 sustained by base 24, carries ball bearings 143 which rotatably sustain the rotatable part 73. Cam 78 (FIG. 7) functions to position the outlet port 42. The cam may be an integral part of pulley 27 or placed in any position accessible to the rotating part. Pressure roller 79 is mounted on arm 81 hinged at 80 and elastically opposed by means of spring 37. Hinge point 80 acts as the hinge point for both arm 81 and lever 230. The thrust movement 82 as shown actuates lever 230. Element 83 is generically any means (for example clamping positioning arms, aspirators mouth, scissors, etc.) which is capable of utilizing the constant positioning of the yarn 25, as it emerges from the rotating part in the preparation phase, for mechanizing and semi-mechanizing the phases subsequent to double twisting in order to deliver the head of the yarn to the bobbin 10 in an automatic way.

According to FIG. 2 or 6, port 36 receives the pressurized fluid from nozzle 35 and delivers it to conduit 76 in pulley 27.

According to FIG. 5 the port 36 receives the pressurized fluid and delivers it to a distribution chamber and from there it passes into conduits 76, 57 and 56 to arrive at the fluid reception chamber 49.

In FIG. 5 it is technically possible to introduce the yarn without the need to stop the spindle if the problems of delivery and positioning of emerging yarn while the spindle is in rotation are solved.

In FIGS. 2 and 6, however, it is necessary to stop and position the spindle, but in this case the yarn always emerges at the required position making it possible to mechanize the yarn take-up and hence possible to mechanize positioning the yarn. This also makes the insertion of the double twist device in completely automatic machines possible.

The device functions when the pressurized fluid is compressed air as hereinafter stated. Stopping the spindle by means known in the art, not illustrated herein owing to its irrelevance to understanding the subject matter of the invention, one proceeds by connecting the nozzle 35 with the port 36, where they are not already connected as in the case of FIG. 5, provided the rotatable part has already been positioned.

Once nozzle 35 is connected with port 36 pressurized fluid is introduced creating in the injector an aspirator effect which effects port 52.

In FIGS. 6 and 7, the procedure is different since automatic positioning of the rotating part of the spindle is envisaged.

Stopping the spindle, by means of a known non-illustrated system is irrelevant to the invention. The operator exerts pressure according to arrow 82 on arm 230 in FIGS. 7 and 6. This action causes the roller 79 to come in contact with the cam 78 at a location thereon. It is clear that the contact between roller 79 and cam 78 could take place at any rotational position of the cam 78.

Due to the thrust by the roller 79 against cam 78, a turning component is generated on the cam 78 which turns the latter and with it the rotating part 27, 73 of the spindle 18 is rotated.

This turning exists until the roller 79 reaches the dead point of cam 78, that is a point nearest to the central line of part 73 of spindle 18. This point will be called hereinafter D.P. (dead point).

When the cam 78 is in a D.P. position with respect to roller 79, the conduit 71 is positioned in a definite manner with respect to the longitudinal axis of the machine and with respect to the plane normal to such axis passing through the vertical axis of the spindle.

Such definite positioning can be utilized for totally or partially mechanizing the subsequent phases necessary to take the yarn to the bobbin that collects it after being double twisted.

For such mechanization, for demonstrative purposes only, means 83 is generically indicated since such means can be constituted of devices considerably different from each other in function to the different tasks they are required to perform.

According to the illustrated preferential embodiment in FIGS. 6 and 7, when roller 79 eases itself in the D.P. of cam 78, by continuing to press on lever 230, the resistance of spring 37 is overcome and nozzle 35 connects with the entry port of conduit 36.

Continuing to press against lever 230, lever 39 acts on the spoiler 31 and causes the pressurized fluid, coming from conduit 32 to flow in conduit 76 and from there to chamber 49.

At this point the yarn drawn from feed bobbin 21 can be introduced through the unwinding terry 19, into port 52 from which it is automatically drawn downwardly and made to emerge from port 42, to be then conducted upwardly along the balloon breaker container 20 by the escaping pressurized air and bowl 40. The pressurized air coming from 36 enters conduit 76, rises upwardly in conduits 57, 56, expands in chamber 49 and enters chamber 58.

From chamber 49 the air is accelerated in channel 48 and arrives in the mixing section 50 travelling at a high velocity in front of port 46 of nozzle 47 causing a negative pressure in the port which negative pressure is transmitted to port 52. From the mixing section 50, the air drawn into 52 passes into 51 and emerges from 42 drawing with it the head of the yarn.

In chamber 58, the air presses on piston 54 which, with the head 59, pushes upwardly against the external wings of the clamp 60 to overcome the elastic resistance of ring 62.

This action opens the clamp 60 and allows the yarn introduced in port 52 to be freely drawn and ejected by port 42.

With the nozzle detached from the rotating part the rotating part can be freely put in motion and it is possible to proceed to the action of double twisting. To regulate the tension of the yarn, it is sufficient to act on ring 67 reducing or increasing the preload on spring 63.

The spindle of this invention is simple, of simple construction and substantially free of maintenance.

In addition the spindle is positionable at will and mechanizable.

One embodiment of the invention has been described although many variants are possible.

Thus it is possible to change the proportions and dimensions and add or remove some parts. It is possible to vary the types of connections for the pressurized fluid emission and add treatment and/or lubricant substances to the pressurized fluid. It is possible to place the nozzle 47 in a higher position, and not to penetrate which is contrary to how it has been illustrated. It is possible to provide a different type of clamp 60 and a different type of presser 62. It is possible to provide one single conduit for conduits 76 and 56 or 56 and 57. It also is possible to provide any other type of positioner in the rotating part of the spindle. The chamber 78 can be made in any position. It is possible to vary the progressive compression set system of the roller. It is possible to modify the cam form or vary device 130. It also is possible to separate the positioning function from the connection function of the fluid feed nozzle.

These and other variants are possible to obtain by an expert in the art without going beyond the ambit of the invention.

What is claimed is:

1. A spindle for double twisting with pneumatic treading, comprising a rotatable part containing a yarn passage conduit therein, a tubular stationary part coaxially positioned above said rotatable part, said stationary part and rotatable part together forming a converging nozzle creating a venturi effect along the axial portion of the yarn passage conduit, a pressurized fluid feed conduit in said rotatable part, said stationary part defining a reception and distribution chamber in communication with said pressurized fluid feed conduit, pressurized fluid transport means in communication with said fluid feed conduit, a yarn clamp within said tubular stationary part and means for overcoming the braking pressure of said clamp.

2. The spindle of claim 1 wherein said pressurized fluid feed conduit positioned longitudinally of said rotatable part includes a reception mouth at a point in said rotatable part.

3. The spindle of claim 2 including a pulley on said rotatable part which contains said reception mouth.

4. The spindle of claim 3 including a cam and an external means for positioning said rotatable part, said rotating part carrying said cam which cooperates with said external means.

5. The spindle of claim 4 wherein the external means for positioning the rotatable part actuates the pressurized fluid transport means which feed the injector.

6. The spindle of claim 1 including a stationary fluid distribution chamber having a reception mouth for pressurized fluid.

7. The spindle of claim 1 wherein the clamp has lateral wings and the means for overcoming the clamp braking pressure consists of a chamber and an elastically pressed piston movable axially in the chamber in the stationary part against at least one lateral wing of the clamp, said chamber being pneumatically connected to the distribution chamber.

* * * * *